US012714915B2

(12) United States Patent
Godoy

(10) Patent No.: US 12,714,915 B2
(45) Date of Patent: Aug. 25, 2026

(54) SWIMMING GOGGLES

(71) Applicant: CRESSI-SUB S.p.A., Genoa (IT)

(72) Inventor: Carlos Alberto Godoy, Genoa (IT)

(73) Assignee: CRESSI-SUB S.p.A., Genoa (IT)

( * ) Notice: Subject to any disclaimer, the term of this patent is extended or adjusted under 35 U.S.C. 154(b) by 0 days.

(21) Appl. No.: 19/029,668

(22) Filed: Jan. 17, 2025

(65) Prior Publication Data

US 2025/0235748 A1 Jul. 24, 2025

(30) Foreign Application Priority Data

Jan. 18, 2024 (IT) ..... 202024000000195

(51) Int. Cl.
*A63B 33/00* (2006.01)

(52) U.S. Cl.
CPC ..... *A63B 33/002* (2013.01)

(58) Field of Classification Search
None
See application file for complete search history.

(56) References Cited

U.S. PATENT DOCUMENTS 4,977,627 A * 12/1990 Metcalfe ..... A61F 9/028 2/447
5,603,125 A * 2/1997 Chou ..... A63B 33/004 351/178
5,903,929 A * 5/1999 Chou ..... A63B 33/004 2/452
6,023,791 A * 2/2000 Chiang ..... A63B 33/004 2/444
6,098,206 A * 8/2000 Chou ..... A63B 33/004 2/428
6,138,286 A * 10/2000 Robrahn ..... G02C 7/104 351/44
6,317,897 B1 11/2001 Chiang
7,290,294 B2 * 11/2007 Kita ..... A61F 9/025 2/443

(Continued)

FOREIGN PATENT DOCUMENTS

CN 201453971 U 5/2010
CN 218010907 U 12/2022
ES 2228407 T3 4/2005

OTHER PUBLICATIONS

Extended European Search Report issued in European Patent Application No. 24223659.4 dated Jun. 16, 2025.

*Primary Examiner* — Matthew R Marchewka
(74) *Attorney, Agent, or Firm* — TROUTMAN PEPPER LOCKE LLP

(57) ABSTRACT

Swimming goggles include at least one lens, a support frame for said at least one lens, featuring at least one annular frame element congruent with the perimeter of said at least one lens, and a gasket designed to rest on a swimmer's face. The gasket includes at least one annular gasket portion congruent with the perimeter of said at least one annular frame element, where said at least one annular gasket portion has a shaped perimeter edge engaged in a fluid-tight manner with said at least one annular frame element. Said at least one lens is formed as a single piece, peripherally featuring a reinforcement frame equipped with fluid-tight clamping means for securing said at least one lens against the shaped perimeter edge of said at least one annular gasket portion.

5 Claims, 7 Drawing Sheets

(56) References Cited

U.S. PATENT DOCUMENTS

| | | | | |
|---|---|---|---|---|
| 8,161,578 | B1 * | 4/2012 | Chou | A63B 33/002 2/440 |
| 8,235,523 | B2 * | 8/2012 | Yang | A61F 9/025 2/441 |
| 2011/0056003 | A1 | 3/2011 | Chen | |
| 2015/0143619 | A1 * | 5/2015 | Cross | A63B 33/002 2/427 |
| 2016/0327810 | A1 * | 11/2016 | Cross | B63C 11/12 |
| 2023/0088521 | A1 * | 3/2023 | Shiue | A63B 33/002 2/440 |

* cited by examiner

SWIMMING GOGGLES

CROSS REFERENCE TO RELATED APPLICATION

This application claims benefit of priority to Italian Patent Application No. 202024000000195, filed Jan. 18, 2024, the entire contents of which are hereby incorporated by reference.

FIELD

The present invention relates to swimming goggles, of the most well-known and widespread type, comprising at least one lens, typically two lenses, and a supporting structure that surrounds them and extends behind them in the form of a soft, elastic gasket designed to rest against the swimmer's eye sockets.

BACKGROUND

The two distal lateral ends of this supporting structure are connected to a strap that serves to secure the goggles to the swimmer's head via buckles that allow for the adjustment of their length and tension.

Swimming goggles have long been available on the market in which the lens(es) are attached to the supporting structure by means of separate elements such as retaining frames, which, when engaged with the supporting structure, secure the lens(es) against the soft elastic gasket, ensuring the fluid-tightness of the goggles to protect the swimmer's eyes.

Swimming goggles are also known in which the lens(es) are directly co-molded with the supporting structure and the elastic gasket.

However, these traditional swimming goggles are known to present certain drawbacks: in the first case, the separate retaining element can deform during use and/or handling of the goggles, compromising their fluid-tightness; in the second case, even minor damage to a single lens necessitates the replacement of the entire goggle, as it is not possible to replace just the damaged lens.

There is therefore a need to improve the structure of a known type of swimming goggle.

SUMMARY

The technical objective of the present invention is to provide swimming goggles that eliminate the technical drawbacks of the prior art.

Within this technical objective, one aim of the invention is to provide swimming goggles that allow for simple assembly of the lens(es) to the supporting structure.

Another aim of the present invention is to provide swimming goggles that allow for simple assembly of the lens(es) to the supporting structure while ensuring the fluid-tightness of the goggle components to protect the swimmer's eyes.

Lastly, another aim of the invention is to provide for the simple and reversible assembly of the lens(es) to the supporting structure.

The technical objective, as well as these and other aims, according to the present invention, are achieved by providing swimming goggles comprising: at least one lens; a support frame for said at least one lens, featuring at least one annular frame element congruent with the perimeter of said at least one lens; a gasket designed to rest on the swimmer's face, comprising at least one annular gasket portion congruent with the perimeter of said at least one annular frame element, said at least one annular gasket portion having a shaped perimeter edge engaged in a fluid-tight manner with said at least one annular frame element. The goggles are characterized by the fact that said at least one lens is formed as a single piece, peripherally featuring a reinforcement frame equipped with fluid-tight clamping means for securing said at least one lens against the shaped perimeter edge of said at least one annular gasket portion.

In a preferred embodiment, the clamping means comprise at least a plurality of teeth engaged in a corresponding plurality of coupling seats provided in said at least one annular frame element.

Other features of the present invention are further defined in the subsequent claims.

Additional features and advantages of the invention will become more apparent from the description of a preferred, but not exclusive, embodiment of swimming goggles according to the invention, in which the goggles have two separate lenses. However, the scope of protection also extends to swimming goggles comprising a single, unified lens.

BRIEF DESCRIPTION OF THE DRAWINGS

The preferred, but not exclusive, embodiment of the invention is illustrated by way of example and not limitation in the accompanying drawings, in which.

DETAILED DESCRIPTION

Figure 1:
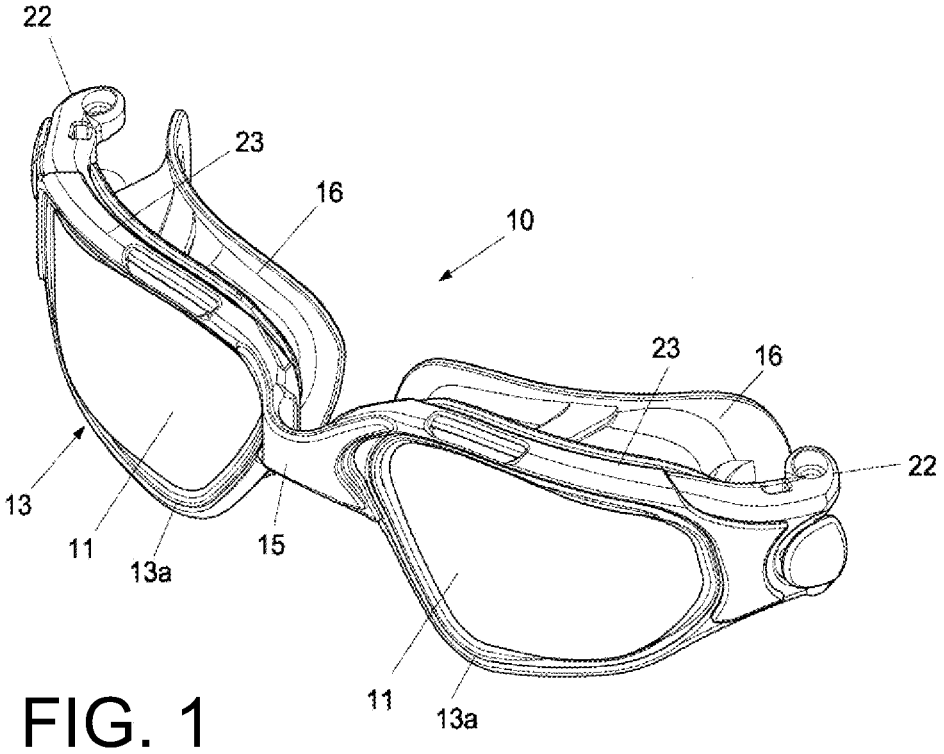
FIG. 1 shows a perspective view of the swimming goggles.
Figure 2:
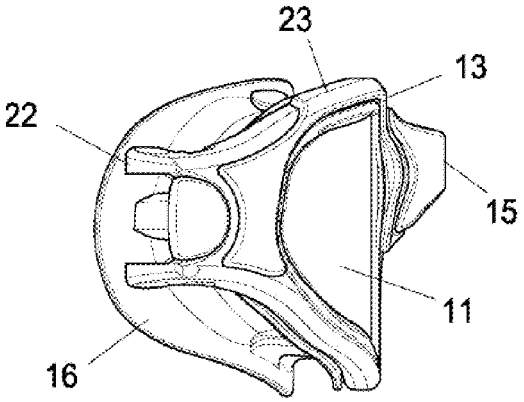
FIG. 2 shows a side elevation view of the swimming goggles.
Figure 3:
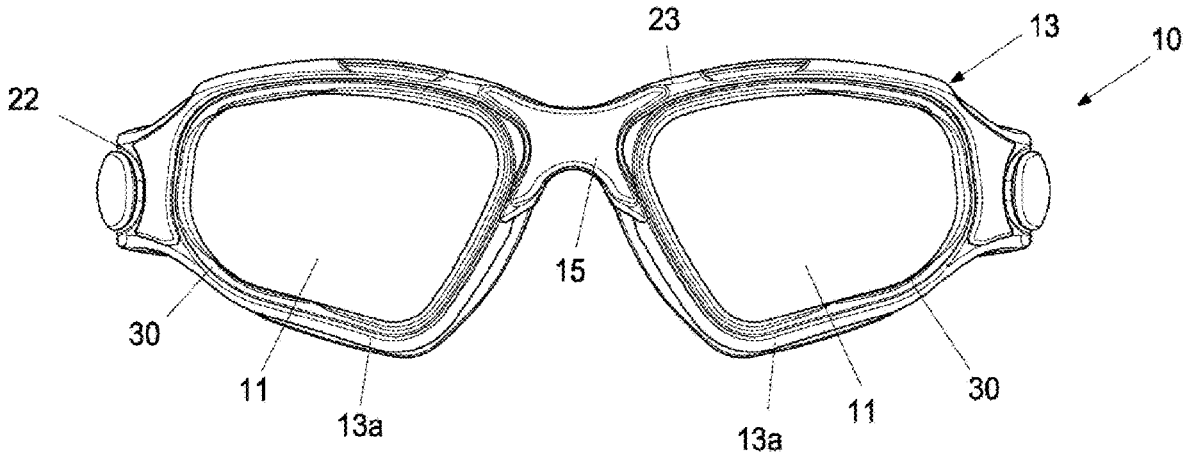
FIG. 3 shows a front view of the swimming goggles.
Figure 4:
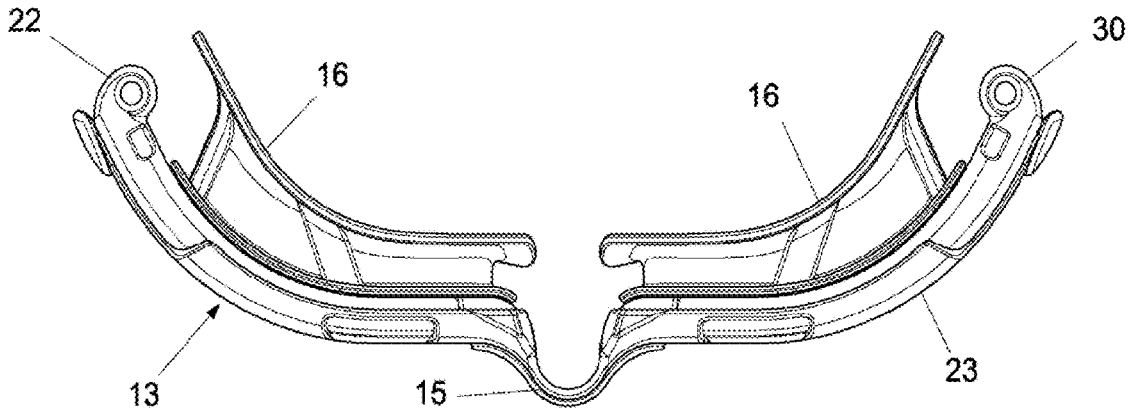
FIG. 4 shows a top plan view of the swimming goggles.
Figure 5:
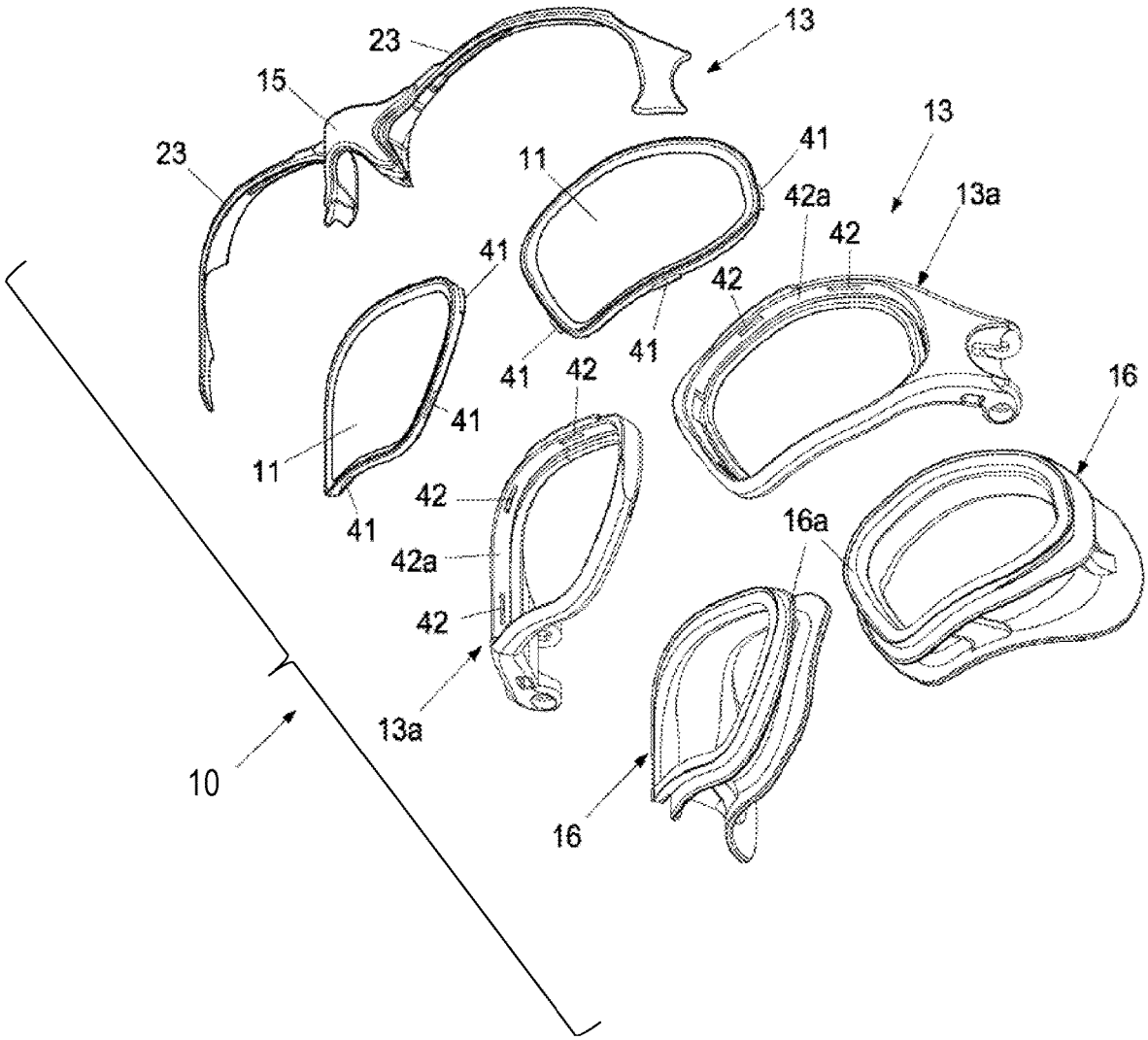
FIG. 5 shows an exploded view of the swimming goggles.
Figure 6A:
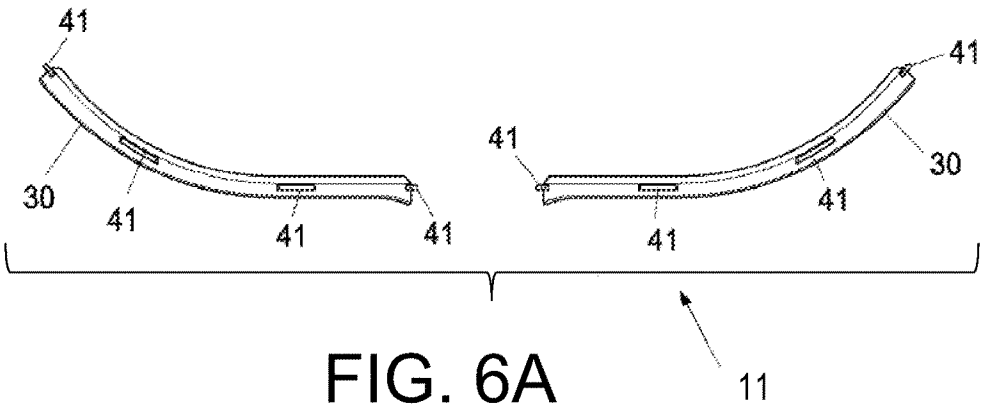
FIGS. 6A, 6B, and 6C show top plan, front, and side elevation views of the lenses, respectively.
Figure 6B:
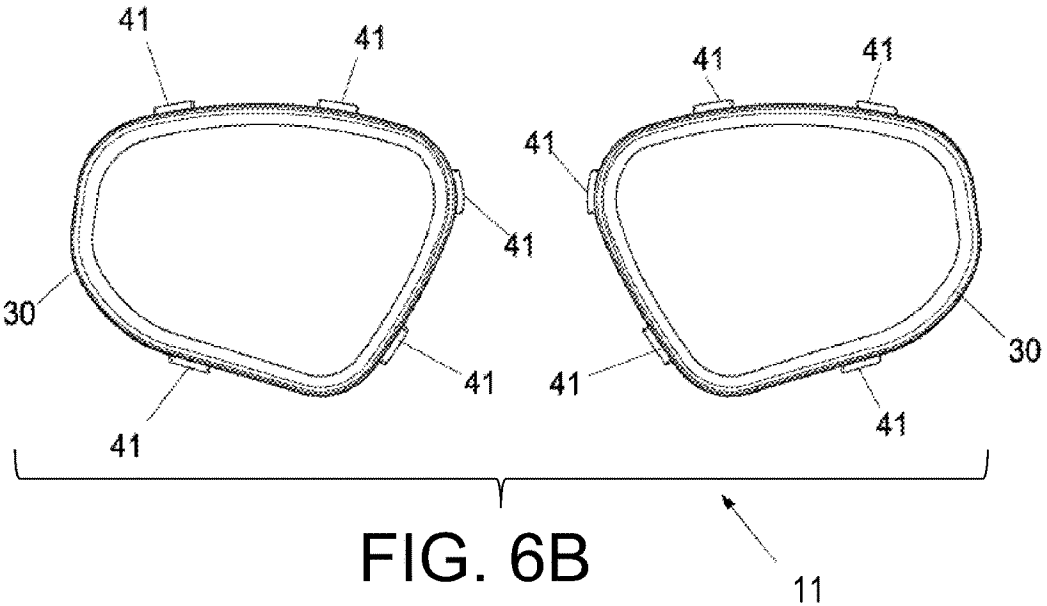
Figure 6C:
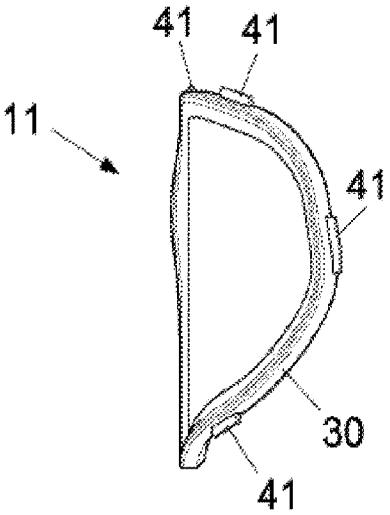
Figure 7:
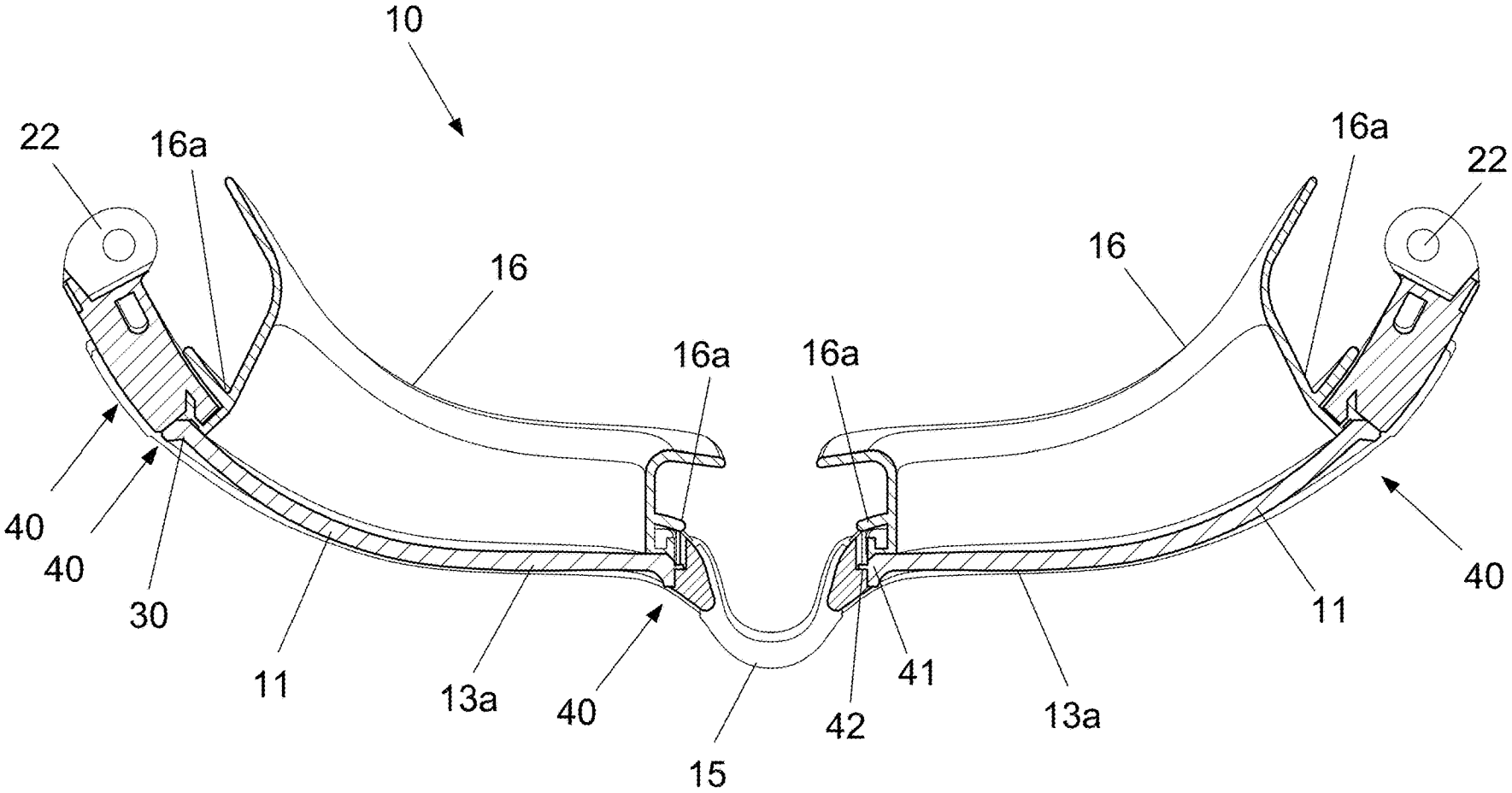
FIG. 7 shows a horizontal sectional plan view of the swimming goggles.
Figure 7A:
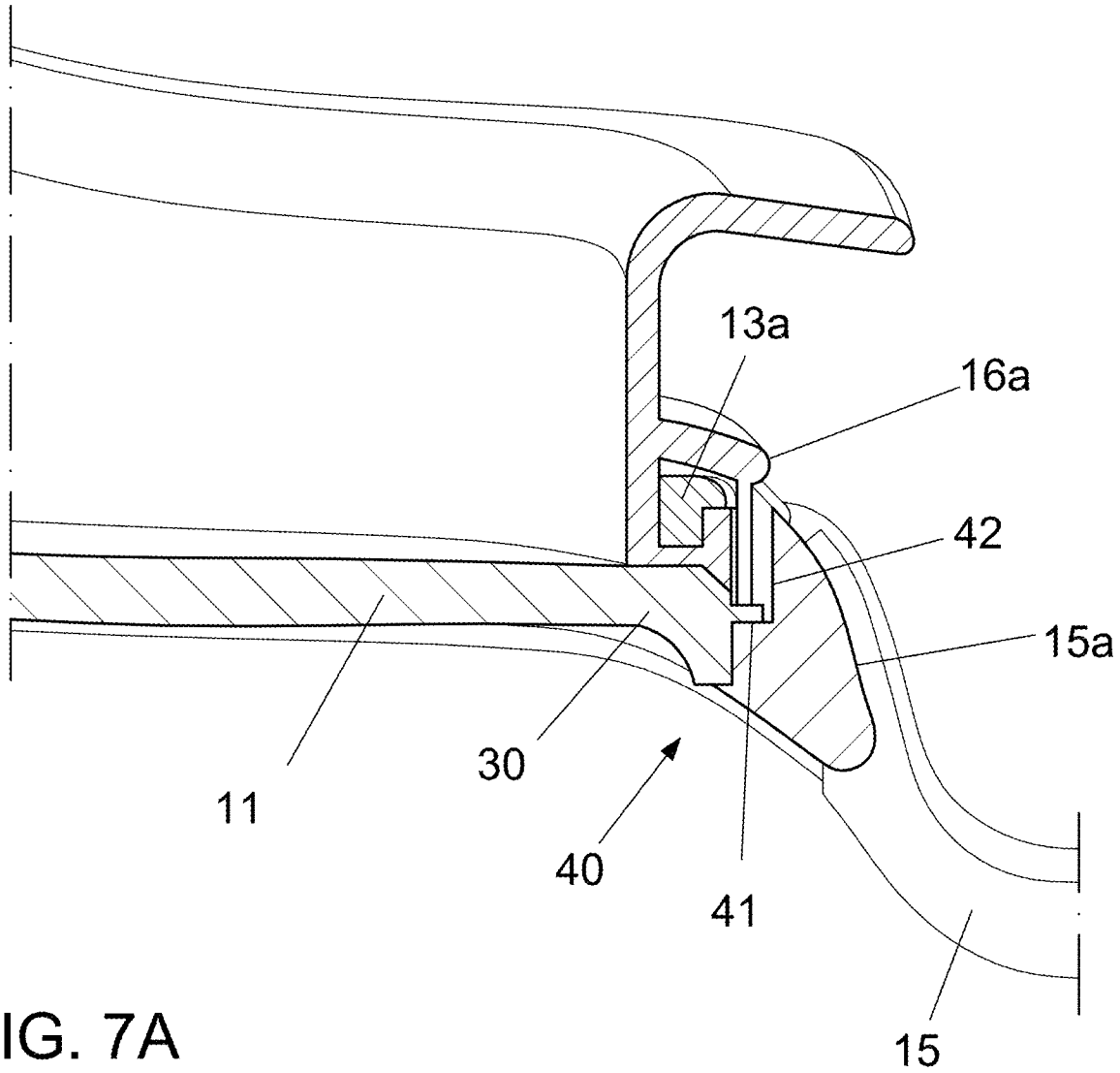
FIG. 7A shows an enlarged detail of FIG. 7.

The following detailed description refers to the accompanying drawings, which form part of this description. In the drawings, similar reference numbers typically identify similar components unless otherwise indicated by the context.

The illustrative embodiments described in the detailed description and shown in the drawings are not intended to be limiting. Other embodiments may be employed, and further modifications may be made without departing from the spirit or scope of the subject matter disclosed herein.

The aspects of the present description, as generally described herein and illustrated in the figures, may be arranged, substituted, combined, and designed in a wide variety of different configurations, all of which are explicitly contemplated and form part of this description.

With reference to the cited figures, swimming goggles are shown, collectively indicated by reference number 10.

The swimming goggles 10 comprise: two lenses 11 and a rigid support frame 13 for the two lenses 11, which features two annular frame elements 13*a*, each congruent with the perimeter of a corresponding lens 11.

The support frame 13 is rigid to ensure that the shape of the annular frame elements 13*a* matches the perimeter of the lenses and to hold end buckles 22 for connecting the goggles to a strap that secures them to the swimmer's head.

The swimming goggles 10 also include a gasket designed to rest on the swimmer's face, comprising two annular gasket portions 16, each congruent with the perimeter of a corresponding annular frame element 13*a*.

The support gasket is suitably made of a soft material. Each annular gasket portion 16 features a shaped perimeter edge 16*a* engaged in a fluid-tight manner with the corresponding annular frame element 13*a* through elastically reversible means by elastic deformation.

Figure 8:
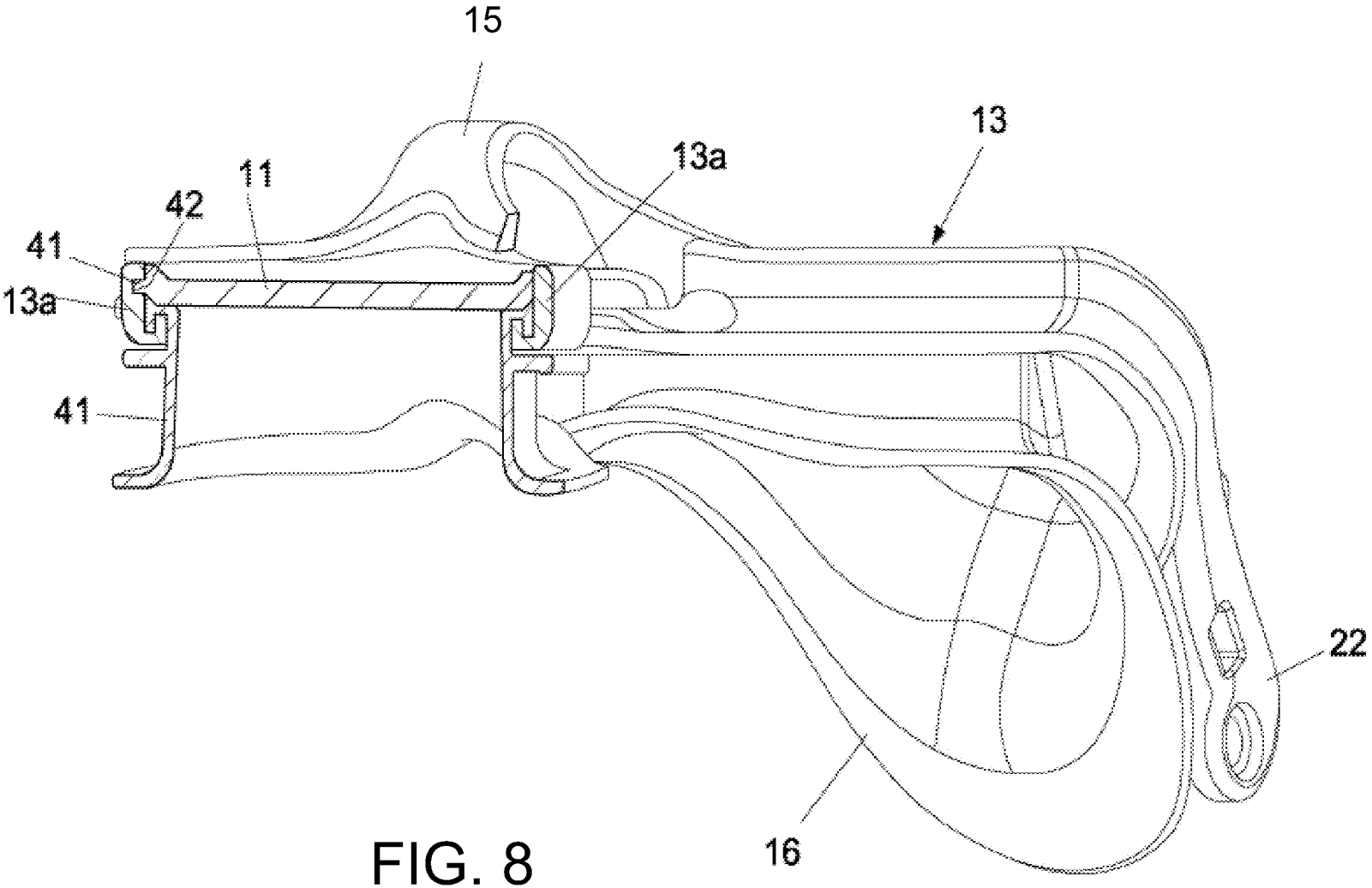
FIG. 8 shows a perspective view of a sectioned portion of the swimming goggles.

Typically, these elastically reversible means are configured as complex perimeter sections of the annular gasket portion 16, which engage reciprocally in complex conjugate perimeter sections of the corresponding annular frame element 13*a*, the perimeter sections being U-shaped as illustrated in at least FIG. 8.

Advantageously and innovatively, according to the present invention, the lenses 11 are formed as a single piece, featuring a peripheral reinforcement frame 30, which is equipped with fluid-tight clamping means 40 for securing the lenses 11 against the shaped perimeter edge 16*a* of the annular gasket portions 16.

The peripheral reinforcement frame 30 is formed as a peripheral thickening of the lenses 11.

Advantageously, the clamping means 40 include a plurality of teeth 41 that elastically and reversibly engage frontally in a corresponding plurality of coupling seats 42 located on the annular frame elements 13*a*.

The coupling seats 42 are formed as blind recesses distributed along an internal annular surface 42*a* of the annular frame elements 13*a*, congruent with the perimeter surface of the lenses 11.

In one embodiment, the rigid frame 13 includes at least a second rigid element 15 configured to fit the shape of the user's nasal bridge.

In another embodiment, arcuate longitudinal elements 23 extend from opposite sides of the second rigid element 15, running along the upper arch of the annular frame elements 13*a*.

Typically, the swimming goggles 10 are manufactured by molding thermoplastic materials: the support frame 13 is made of polypropylene; the sealing gasket is made of silicone or thermoplastic rubber; and the lenses 11, along with the reinforcement frame 30, are monolithically molded in polycarbonate.

The simple assembly process of the swimming goggles, as described and illustrated, can be summarized as follows:

Each rigid annular frame element 13*a* is elastically engaged at the rear with the shaped perimeter edge 16*a* of the corresponding annular gasket portion 16 to form a fluid-tight seal.

The corresponding lens 11 is then frontally engaged with the annular frame element 13*a* and gasket portion 16 assembly using the fluid-tight clamping means 40. The plurality of teeth 41 elastically and reversibly engage frontally in the corresponding coupling seats 42 in the annular frame element 13*a*.

The elastically reversible engagement of the clamping means 40 allows for the easy removal and replacement of the lens 11 from the annular frame element 13*a* when necessary.

In practice, it has been found that swimming goggles designed in this manner are particularly advantageous for the simple, effective, and reversible assembly of the lenses, ensuring a fluid-tight seal between the goggle components.

Swimming goggles conceived in this way are subject to numerous modifications and variations, all within the scope of the inventive concept as defined by the claims. Additionally, all details may be replaced with technically equivalent elements.

In practice, the materials used, as well as the dimensions, may vary depending on requirements and the state of the art.

What is claimed is:

1. Swimming goggles, comprising:

a lens;

a support frame for said lens, the support frame comprising an annular frame element congruent with a perimeter of said lens;

a gasket configured to rest on a swimmer's face, the gasket comprising an annular gasket portion congruent with a perimeter of said annular frame element, said annular gasket portion having a shaped perimeter edge engaged in a fluid-tight manner with said annular frame element, wherein said lens is formed as a single piece and comprising a reinforcement frame forming a periphery of the single piece, the reinforcement frame equipped with fluid-tight clamping means for securing said lens against said shaped perimeter edge of said annular gasket portion, wherein said fluid-tight clamping means comprises at least a plurality of teeth engaged in a corresponding plurality of coupling seats provided in said annular frame element, and wherein said lens is monolithically molded with said reinforcement frame and said fluid-tight clamping means from polycarbonate, wherein the annular gasket portion comprises a shaped perimeter edge configured to reversibly engage in a fluid-tight engagement with a shaped perimeter edge of the support frame through elastic deformation, wherein the shaped perimeter edge of the annular gasket portion is a U-shape, wherein an opening of the U-shape of the shaped perimeter edge of the annular gasket portion faces away from the lens, wherein the shaped perimeter edge of the support frame is a U-shape, wherein an opening of the U-shape of the shaped perimeter edge of the support frame faces towards the lens, and wherein the fluid-tight engagement is formed by an interlocking of the U-shape of the shaped perimeter edge of the annular gasket portion and the U-shape of the shaped perimeter edge of the support frame.

2. The swimming goggles according to claim 1, wherein said plurality of teeth is configured to reversibly engage said corresponding plurality of coupling seats from a front of said annular frame element through elastic deformation.

3. The swimming goggles according to claim 1, wherein said reinforcement frame is formed as a peripheral thickening of said lens.

4. The swimming goggles according to claim 1, wherein said corresponding plurality of coupling seats are formed as blind recesses distributed along an internal annular surface of said annular frame element congruent with the perimeter of said lens.

5. The swimming goggles according to claim 1, wherein the lens comprises two lenses.

* * * * *